US005104005A

United States Patent [19]

Schneider, Jr. et al.

[11] Patent Number: 5,104,005

[45] Date of Patent: * Apr. 14, 1992

[54] DUAL COMPONENT MECHANICALLY OPERATED CAULKING GUN

[75] Inventors: Franz K. Schneider, Jr., Moorestown, N.J.; Michael V. Haubert, Erdenheim, Pa.

[73] Assignee: Albion Engineering Company, Philadelphia, Pa.

[ * ] Notice: The portion of the term of this patent subsequent to Nov. 14, 2008 has been disclaimed.

[21] Appl. No.: 269,886

[22] Filed: Nov. 10, 1988

[51] Int. Cl.[5] ..... B67D 5/52

[52] U.S. Cl. ..... 222/137; 74/424.8 R; 222/145; 222/390

[58] Field of Search ..... 222/137, 326, 327, 390, 222/145; 74/459, 424.8 NA, 424.8 R

[56] References Cited

U.S. PATENT DOCUMENTS

| | | | |
|---|---|---|---|
| 1,374,263 | 4/1921 | Watson | 222/390 |
| 1,513,781 | 11/1924 | Yates | 222/390 X |
| 1,644,173 | 10/1927 | Carr | 222/390 |
| 2,158,774 | 5/1939 | Grubelic | 222/390 X |
| 3,059,494 | 10/1962 | Grabowski et al. | 74/459 X |
| 3,349,962 | 10/1967 | Levin | 222/137 X |
| 3,419,051 | 12/1968 | Gustafson et al. | 222/390 X |
| 3,570,719 | 3/1971 | Schiff | 222/145 X |
| 4,150,769 | 4/1979 | James | 222/137 |
| 4,198,872 | 4/1980 | Metz | 74/424.8 NA |

*Primary Examiner*—Kevin P. Shaver

*Attorney, Agent, or Firm*—Caesar, Rivise, Bernstein, Cohen & Pokotilow, Ltd.

[57] ABSTRACT

A dual component caulking gun which utilizes a gun body to which there is affixed a dual component cartridge assembly designed to carry dual component cartridges. A ball screw is journaled within the gun body for rotary motion but locked against axial motion and extends in a direction opposite the component cartridge assembly. A pair of ram rods are journaled through the gun body and terminate at the first end in ejector rams and at their opposite end in a transfer bar that is interconnected to the ball screw by means of a ball screw nut.

5 Claims, 3 Drawing Sheets

DUAL COMPONENT MECHANICALLY OPERATED CAULKING GUN

BACKGROUND OF THE INVENTION

The present invention relates to caulking guns and, more particularly, to mechanically operated caulking guns of the type employing dual component cartridges and dual actuating ejector rams for dispensing dual component materials.

There are different types of mechanically operated caulking guns. One of the more familiar ones in the type that uses a ratchet operated by a handgrip to advance a ram rod for dispensing of the caulking material. A second type of mechanical caulking gun is that which utilizes a thread and screw type of mechanism to advance a ram rod for ejecting of the material. It is this latter type to which the present invention is directed.

The caulking industry in recent years has been utilizing dual component materials. These dual component materials are of an epoxy type in many cases and are intermixed in a static mixer and through chemical reaction set up after dispensing. Some of these materials are of different viscosities which create uneven ejection pressures on the ejection rams. Additionally, some of the materials are very thick and difficult to eject and require considerable ejection ram pressure.

The mechanical screw-nut type dual component dispensing guns available in the prior art are subject to jamming by reason of the uneven dispensing pressures created on the ejection pressure creating mechanism. Additionally, such prior art devices utilize a conventional screw and nut type of ejection mechanism and the required pressures very often make operation or rotation of the conventional screw assembly extremely difficult for the operator. Further, the prior art devices suffer from a problem of reverse threading of the screw member by the pressure build up in the cartridges once the operator removes the torque from the screw.

The foregoing problems of conventional prior art caulking guns are addressed in the caulking gun of the present invention.

SUMMARY OF THE INVENTION

The dual component caulking gun of the present invention utilizes a metallic gun body to which there is affixed a dual component cartridge assembly for supporting the dual component cartridges to e dispensed. Extending from the opposite end from the carriage assembly and parallel therewith is a ball screw which is secured into the gun body against axial movement but is journaled within the gun body for rotational movement. The opposite end of the ball screw terminates in a turning knob.

The gun body has journaled therein a pair of ejector rods which extend parallel with the ball screw and the cartridge carriage assembly. The ram rods terminate in their first end adjacent the cartridge assembly in ejector rams. The opposite ends of the ram rods are interlocked into a transfer bar which is positioned around the ball screw. A ball screw nut is threaded upon the ball screw and is interconnected to the transfer bar in a manner such that, as the ball screw is rotated, the ball screw nut will advance along the ball screw and thus advance the ram rods relative to the gun body in either eject or retract directions depending upon the direction of rotation of the ball screw.

A ratchet assembly is provided and utilizes a ratchet spline interconnected to the ball screw. A ratchet dog is carried within the gun body and interacts with the ratchet spline to ratchet the ball screw against rotation in the retract direction. A ratchet release is provided which will disengage the ratchet action of the ratchet assembly permitting the ball screw to be rotated in retract direction.

DETAILED DESCRIPTION OF INVENTION

Figure 1:
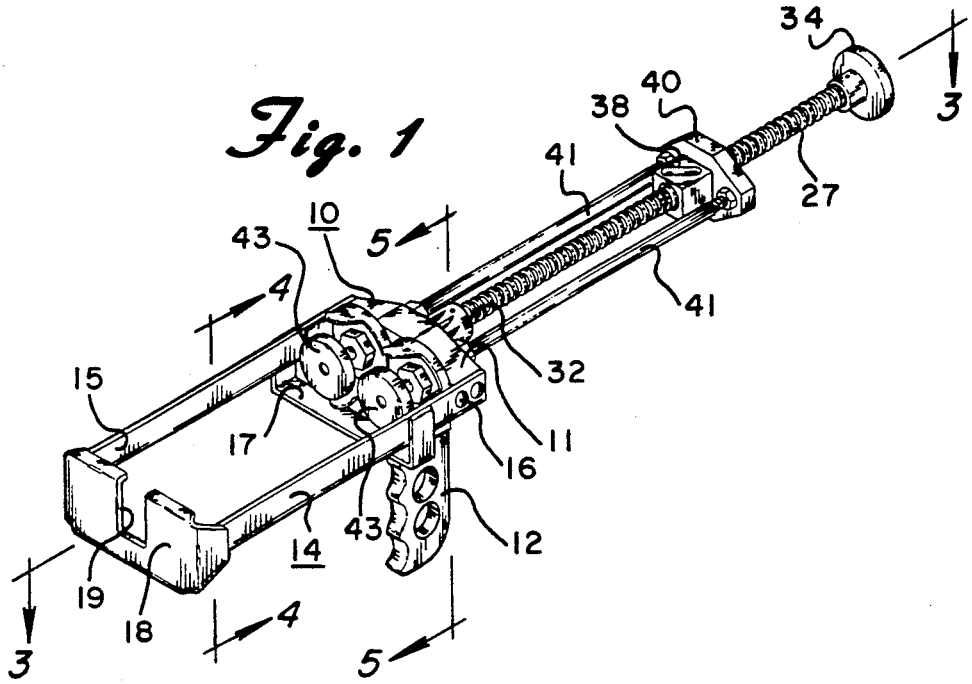
FIG. 1 is a perspective view of the caulking gun of the present invention.
Figure 2:
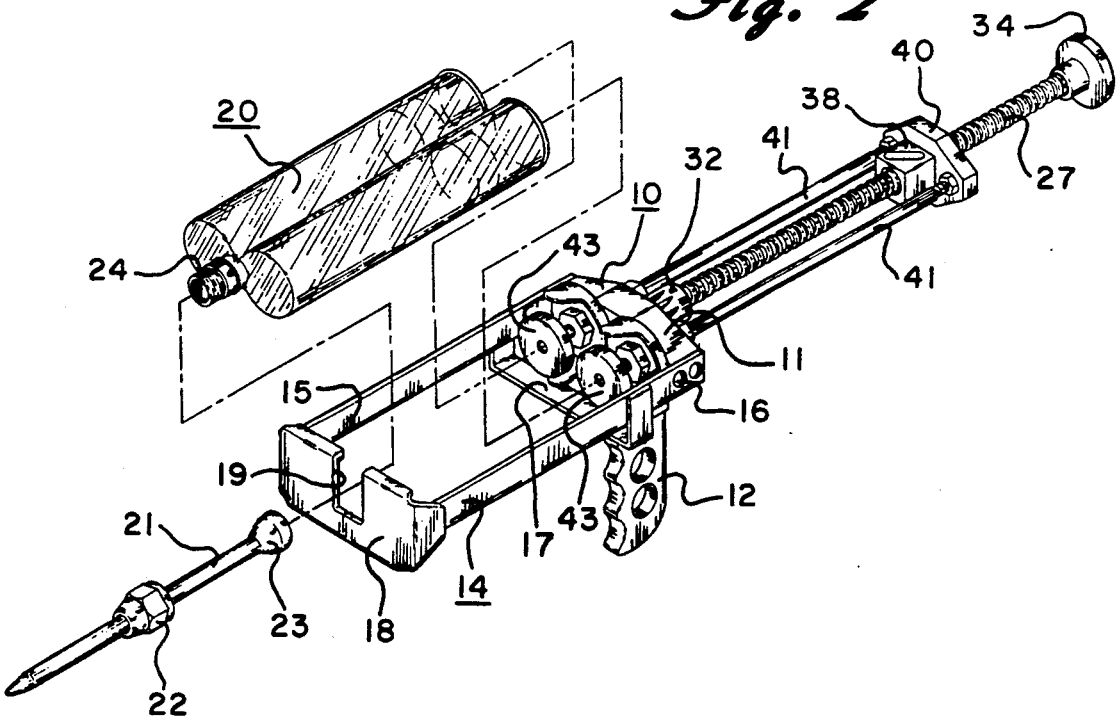
FIG. 2 is a perspective view of the caulking gun of the present invention showing in phantom the dual component cartridges and static mixer.
Figure 4:
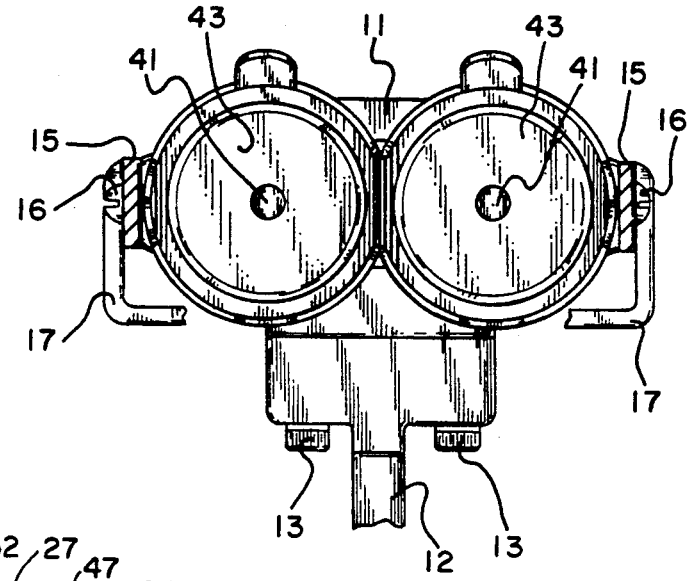
FIG. 4 is an end view of the caulking gun of the present invention taken along the lines 4—4 of FIG. 1.
Figure 5:
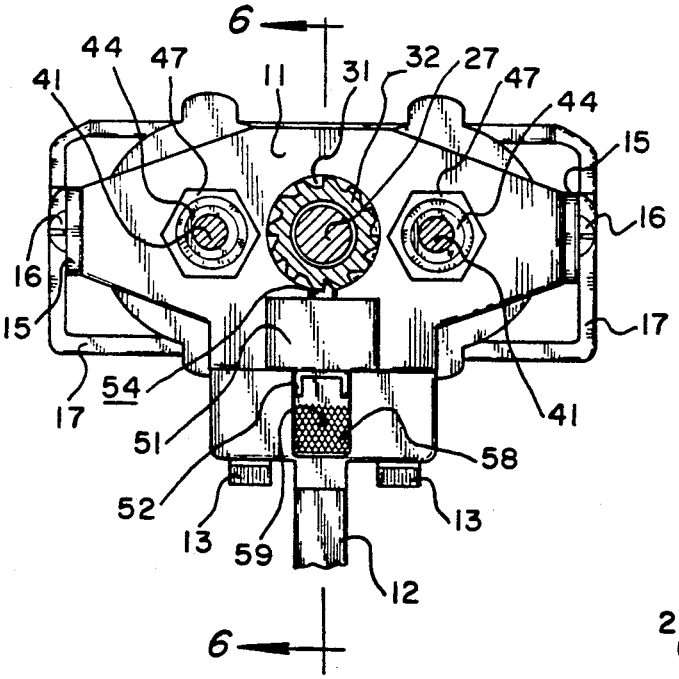
FIG. 5 is a midsection view of the caulking gun of the present invention taken along the lines 5—5 of FIG. 1.

The dual component caulking gun of the present invention is shown in overall in FIGS. 1 and 2 of the drawings. The caulking gun 10 generally includes a gun body 11 which provides the basic foundation for the remaining portions of the gun. A gun handle 12 is attached to the gun body 11 by means of suitable threaded fasteners 13 as best shown in FIGS. 4 and 5 of the drawings.

Extending in a forward direction from the gun body 11 is a carriage assembly 14. The carriage assembly 14 includes two forwardly extending arms 15 which are secured to the gun body 11 by suitable threaded fasteners 16.

A stirrup 17 is secured to the rearmost portion of the arms 15 and extends down and below the arms for a purpose to be described hereinafter. The forward portion of the arms terminate at and provide a support for a component support bracket 18. The component support bracket 18 includes a recess 19 therein.

As more particularly shown in FIG. 2, a dual component cartridge package 20 is adapted to be positioned within the carriage assembly 14 with the rear portion of the cartridges resting upon the stirrup 17. The forward portion of the cartridges includes a semicircular threaded ejection nozzle 24. When the two cartridges are positioned side by side, the two semicircular nozzles, in their offset position, provide a circular threaded nozzle. The two nozzles, when positioned in side by side relationship as shown in FIG. 2, are adapted to receive a threaded static mixer 21 of a known configuration. Basically, the mixer 21 has therein a spiral type path or mixing element that, during ejection, causes the two components to intermix with one another. A threaded nut 22 cooperates with a flange 23 on the static mixer to thread upon the semicircular nozzles 24 to secure the static mixer 21 in place and hold the two component cartridges together.

Figure 3:
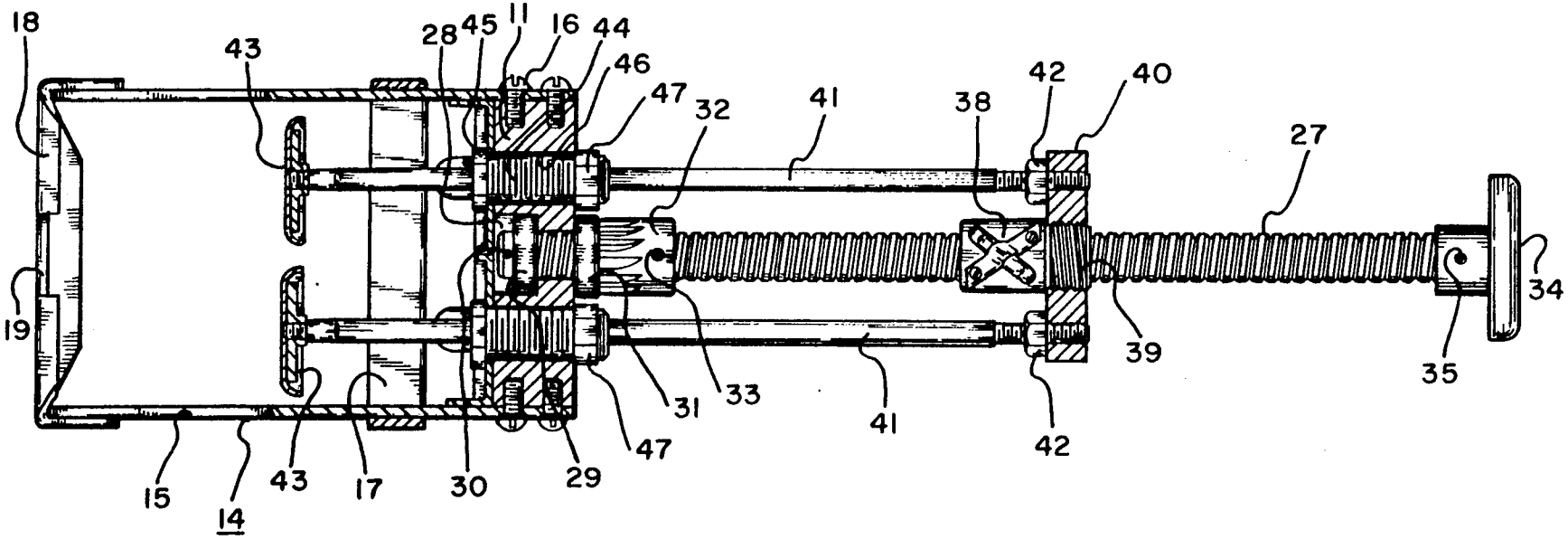
FIG. 3 is a top sectional view of the caulking gun of the present invention taken along the lines 3—3 of FIG. 1.

Referring now to FIG. 3, the gun body 11 has secured therein and extending rearwardly from the carriage assembly an elongate ball screw 27. The forward end of the ball screw is secured within the gun body 11 within a stepped recess 28. The smaller diameter of the stepped recess is just large enough to accept the ball screw. The larger recess is designed to accommodate a forward thrust bearing 29 which secures the ball screw 27 against axial movement in a rearward direction by means of a roll pin 30.

The ball screw 27 is secured against axial movement in a forward direction with respect to the gun body 11 by means of a rear thrust bearing 31 bearing upon the rear side of the gun body 11. The rear thrust bearing 31 works in conjunction with a ratchet assembly 32 similarly secured to the ball screw 27 by means of a roll pin 33. In this manner, the ball screw 27 is locked in respect to the gun body 11 against axial movement therein while the ball screw 27 may freely rotate relative to the gun body 11.

Rotation of the ball screw 27 is accomplished by means of a turning knob 34 secured to the opposite end of the ball screw 27. The turning knob 34 is secured in place by a shear pin 35.

A ball screw nut 38 is threaded upon the ball screw 27. The ball screw 27 and ball screw nut 38 are of the type that employ circulating balls which rotate around within the ball screw nut and into semicircular grooves within the ball screw 27 in a heretofore known mechanical configuration.

The rearward portion of the ball screw nut 38 includes a threaded portion 39 therein which includes a bore therein to permit passage of the ball screw 27 therethrough. The threaded portion 39 is adapted to thread into and be secured to a transfer block 40 which is positioned around the ball screw 27 and will move with the ball screw nut 38 as it traverses in a forward rearward direction upon the ball screw 27.

The transfer block 40 includes the anchor and driving member for a pair of parallel extending ram rods 41. The rearmost portion of the ram rods 41 include a threaded end thereon which are threaded into the transfer block 40 and secured in place by means of lock nuts 42.

The forward ends of the ram rods 41 extend through the gun body 11 and terminate at their opposite ends in ejector rams 43.

The ram rods 41 are journaled within the gun body 11 within bronze bushings 44. The bronze bushings include a nut flange 45 on one end thereof and are threaded throughout their extremity. The bushings 44 are thus adapted to fit within a boring 46 within the gun body 11 with their opposite end extending beyond the rear face of the gun body 11. A retaining nut 47 threaded upon the opposite end of the bushing retains the bushing in place within the gun body 11.

Figure 6:
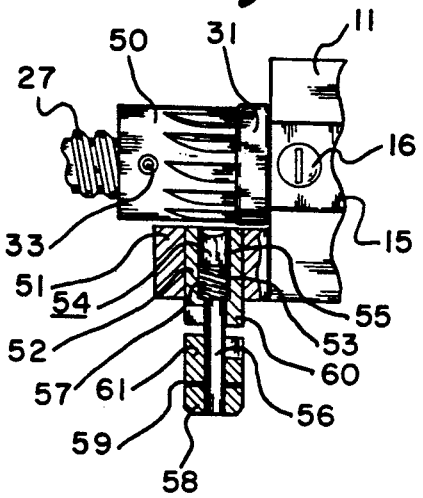
FIG. 6 is a side sectional view of the ratchet assembly utilized in the caulking gun of the present invention taken along the lines 6—6 of FIG. 1.

The details of the ratchet assembly 32 of the present invention are shown in FIGS. 5 and 6 of the drawings. The ratchet assembly includes a ratchet spline 50. As previously described, the ratchet spline 50 is positioned upon the ball screw 27 and is secured thereto by means of a roll pin 33 to maintain the ratchet spline in place and against the rear thrust bearing 31.

The gun body 11 includes a gun body extension 51 which extends rearwardly and beneath the ratchet spline 50. An insert 52 is press fitted into a bore within the gun body extension 51. The insert 52 includes an internal boring 53 therein of a first larger diameter terminating in a drilling of a smaller diameter.

Positioned within the internal boring 53 is a ratchet dog 54 which includes, in its upper portion within the larger bore of the insert, a ratchet paw 55 and an extension shaft 56 of a smaller diameter extending through the smaller boring of the insert 52.

The ratchet dog 54 includes on the extension shaft 56 and within the larger bore a return spring 57. A knurled knob 58 is secured on the lower portion of the extension shaft 56 by means of a roll pin 59.

As best may be seen from FIG. 5 of the drawings, the ratchet assembly is designed with the angle of the splines of the ratchet spline 50 and the angle of the ratchet paw 55 such that the device, under the influence of the return spring 57, will ratchet when turned in a clockwise direction but will lock against rotational movement of the ball screw in a counterclockwise direction. In this manner, as the ball screw 27 is rotated in a clockwise direction by the turning knob 34, the movement of the transfer bar in an eject direction will drive the ram rods 41 and ejector rams 43 into the direction to eject the dual component material from the dual component cartridges. The pressure build up during the ejection process will be prohibited from causing a reverse direction of rotation of the ball screw 27 in the counterclockwise direction whenever the torque is removed from the turning knob. In this manner, undesired reversal of the ball screw is avoided and pressure can be maintained upon the component cartridges without the necessity of having to turn the turning knob to reestablish pressure every time the torque is removed from the turning knob.

As best shown in FIG. 6 of the drawings, whenever it is desired to move the ejector rams into a retract position, the knob 58 is pulled downwardly against the pressure of the return spring 57 to pull the ratchet paw 55 out of engagement with the ratchet spline 50. The lower portion of the insert 52 includes a tang 60 extending downwardly therefrom. The upper portion of the knob 58 includes a similarly proportioned tang 61 which is 180° in alignment from the tang 60. In this manner, once the ratchet dog 54 has been pulled down out of engagement with the ratchet spline, the knob may be turned 180° to align the tangs 60 and 61 to thus maintain the ratchet dog 54 in disengaged position. In this manner, the turning knob 34 may be freely rotated in a counterclockwise direction to retract the ejector rams 43 in order that anew set of dual component cartridges may be put in place into the carriage assembly.

The ratchet assembly shown in FIGS. 5 and 6 of the drawings may be also further modified by the use of a thumb lever to operate the disengagement. What is contemplated is that a lever may be anchored at one end against an appropriate pivot point in the gun body and a pressure point on the thumb lever operate against the knob 58 such that, when cantilevered downwardly, the lever will pull down the ratchet dog 54 while being held by an operator's thumb with his hand upon the handle grip 12 while the operator's other hand is free to turn the turning knob 34 to draw the ejector rams 43 into retract position.

From the foregoing, it will be appreciated that the dual component caulking gun of the present invention provides a caulking gun which is of lightweight and balanced construction. The caulking gun of the present invention also, in its utilization of the ball screw and ball screw nut, is one which can apply great forces upon the dual component material within the cartridges without undue binding of the ball screw. Additionally, by the utilization of the ratchet assembly of the present invention, the dual component caulking gun of the present invention is one which can overcome the problems of reverse threading of the screw actuating mechanism employed in such guns.

The caulking gun of the present invention has been described in respect to the particular embodiment thereof set forth in the specification and as illustrated in the drawings. As a result of such disclosure, other variations and modifications may become apparent to those skilled in the art and therefore, no limitation as to the scope of the invention is intended by the specific embodiments disclosed but the scope of the invention is to be interpreted in view of the appended claims.

What is claimed is:

1. A dual component mechanical caulking gun comprising:

a gun body;

a dual component cartridge assembly affixed to the gun body on a first side of the gun body;

an elongate threaded screw locked within the gun body against axial movement but journaled within the gun body for rotary motion and extending from the gun body in a direction opposite to the first side of the gun body and parallel with the cartridge assembly;

a pair of ram rods extending through and journaled within the gun body for axial movement within the gun body in a line parallel with the elongate screw and each terminating in a ejector ram at a first end thereof on the first side of the gun body and adjacent the cartridge assembly and terminating at their opposite ends on the opposite side of the gun body in a transfer bar; and thread engaging means interconnected between the transfer bar and the threaded screw whereby rotation of the threaded screw will move the transfer bar and ram rods and ejector rams relative to the gun body in eject and retract directions.

2. The caulking gun of claim 1 wherein the threaded screw is a ball screw and wherein the thread engaging means is a ball screw nut.

3. The caulking gun of claim 1 further including a ratchet assembly interconnected between the threaded screw and the gun body to lock the threaded screw against rotation in retract direction.

4. The caulking gun of claim 3 further including ratchet release means to permit the threaded screw to be rotated in retract direction.

5. The caulking gun of claim 4 wherein the threaded screw is a ball screw and wherein the thread engaging means is a ball screw nut.

* * * * *